US005762880A

United States Patent [19]

Rühl et al.

[11] Patent Number: 5,762,880

[45] Date of Patent: Jun. 9, 1998

[54] OPERATIONAL PROCESS AND ITS IMPROVED CONTROL SYSTEM OF A SECONDARY AIR BURNER

[75] Inventors: Andreas C.H. Rühl; Kim A. Anderson; Michael G. Tesar, all of Green Bay, Wis.

[73] Assignee: Megtec Systems, Inc., DePere, Wis.

[21] Appl. No.: 767,000

[22] Filed: Dec. 16, 1996

[51] Int. Cl.[6] ..... G05D 23/00

[52] U.S. Cl. ..... 422/109; 431/5; 423/245.3; 588/900

[58] Field of Search ..... 431/5; 422/109, 422/110; 423/DIG. 5, 245.3; 588/900

[56] References Cited

U.S. PATENT DOCUMENTS

| | | | |
|---|---|---|---|
| 2,124,175 | 10/1938 | Zink | 158/11 |
| 3,115,851 | 12/1963 | Ceely | 110/22 |
| 3,549,333 | 12/1970 | Tabak | 23/277 |
| 3,589,852 | 6/1971 | Buchanan | 431/158 |
| 3,806,322 | 4/1974 | Tabak | 23/277 |
| 3,838,975 | 10/1974 | Tabak | 23/277 C |
| 3,898,040 | 8/1975 | Tabak | 23/277 C |
| 4,003,692 | 1/1977 | Moore | 431/158 |
| 4,038,032 | 7/1977 | Brewer | 422/109 |
| 4,155,701 | 5/1979 | Primas | 431/183 |
| 4,303,386 | 12/1981 | Voorheis et al. | 431/177 |
| 4,334,854 | 6/1982 | Graat et al. | 431/8 |
| 4,364,724 | 12/1982 | Alpkvist | 431/11 |
| 4,365,951 | 12/1982 | Alpkvist | 431/82 |
| 4,444,735 | 4/1984 | Birmingham et al. | 423/210 |
| 4,850,857 | 7/1989 | Obermuller | 431/242 |
| 5,333,395 | 8/1994 | Bulcsu | 34/79 |

FOREIGN PATENT DOCUMENTS

| | | |
|---|---|---|
| 2037864 | 9/1991 | Canada . |
| 23 52 204 | 4/1975 | Germany . |
| 30 43 286 | 10/1981 | Germany . |
| 33 32 070 | 8/1985 | Germany . |
| 43 23 475 | 1/1995 | Germany . |

*Primary Examiner*—Carroll B. Dority

*Attorney, Agent, or Firm*—Mitchell D. Bittman; Kevin S. Lemack

[57] ABSTRACT

Control system and method for monitoring and controlling the stoichiometry of a secondary air burner in a thermal oxidizer. The burner control system secures a certain stoichiometry independent of possible simultaneous changes of the gas mixture flow rate and/or of the combustible impurity concentration in the process gas. The firing rate of the burner is adjusted by a controller. Additionally, the flow of the burner fuel and of the process gas mixture are measured and transformed into separate signals. Both signals are sent to an evaluation apparatus that compares the signals and generates a third signal based upon that comparison. This third signal is in communication with a device that changes the gas mixture flow resistance, and thus the desired amount of gas mixture will be diverted for the combustion of the fuel.

12 Claims, 3 Drawing Sheets

OPERATIONAL PROCESS AND ITS IMPROVED CONTROL SYSTEM OF A SECONDARY AIR BURNER

BACKGROUND OF THE INVENTION

The present invention relates to an operational process for controlling a secondary air burner such as in a thermal oxidizer apparatus.

The control and/or elimination of undesirable impurities and by-products from various manufacturing operations has gained considerable importance in view of the potential pollution such impurities and by-products may generate. One conventional approach for eliminating or at least reducing these pollutants is by thermal oxidization via incineration. Incineration occurs when contaminated air or process gas containing sufficient oxygen is heated to a temperature high enough and for a sufficient length of time to convert the undesired compounds into harmless gases such as carbon dioxide and water vapor. Thermal oxidation is used when the concentration of the combustible impurities of the process gas lies outside the limits of the explosion levels. To maintain thermal oxidation, supplemental energy must be fed to the combustion chamber of the thermal oxidizer, although in some cases supplemental energy is only required to start the process. Preferably the energy content of the cleaned process gas is used, if economically feasible, to heat the uncleaned process gas. This reduces the demand for supplemental energy. Excess heat generated also may be used for other purposes.

A secondary air burner is used in thermal oxidizers to combust fuel inside a closed system of a gas mixture that contains oxygen (the process gas). The main function of the burner is to heat the process gas to a required temperature by means of thermal oxidation. Liquid or gaseous fuel, such as fuel oil, town gas, natural gas, liquid gas, top gas, waste solvents or used lubricating oils etc. may be used. A secondary air burner saves fuel, because the burner uses the oxygen already present in the process gas and does not require any external oxygen source that would consume a part of the released combustion energy.

According to conventional combustion science, each type of burner flame (e.g., premix flame, diffusion flame, swirl flame, etc.) burns with a different optimal stoichiometric mix of fuel to combustion air, by which low emission concentrations in the burner flue gas appear. It is therefore important to control or maintain the desired optimal stoichiometry of the burner. However, this is very difficult when process gas is used to partially fuel the burner, since the flow rate of the process gas as well as the concentration of oxidizable substances in the process gas may constantly change even within a given process. For example, thermal oxidizers are often used to combust process gas emitted from a printing press, where the concentration of solvents from the ink being dried vary over time in the process gas.

It is therefore an object of the present invention to secure a constant or substantially constant stoichiometric mix of fuel and combustion air in a secondary burner independent of possible simultaneous changes in the volumetric flow rate of the process gas and/or in the combustible impurity concentration of the process gas.

It is a further object of the present invention to provide a control system for a secondary air burner by employing flow metering devices accompanying a controller that operates a device for diverting a portion of the process gas that is used as combustion air.

It is a still further object of the present invention to increase the fuel efficiency of a burner.

It is another object of the present invention to reduce the flue gas emissions of a burner.

SUMMARY OF THE INVENTION

The problems of the prior art have been overcome by the present invention, which provides a control system and method for monitoring and controlling the stoichiometry of a secondary burner in a thermal oxidizer. As a result, a certain temperature in the oxidation chamber of the thermal oxidizer is maintained.

The burner control system secures a certain stoichiometry independent of possible simultaneous changes of the gas mixture flow rate and/or of the combustible impurity concentration in the process gas. The firing rate of the burner is adjusted by a controller. Additionally, the flow of the burner fuel and of the process gas mixture are measured and transformed into separate signals. Both signals are sent to an evaluation apparatus that compares the signals and generates a third signal based upon that comparison. The gas mixture flow resistance is regulated in response to this third signal, such as with one or more dampers or by movement of the burner, and thus the desired amount of gas mixture will be diverted for the combustion of the fuel.

DETAILED DESCRIPTION OF THE INVENTION

Figure 1:
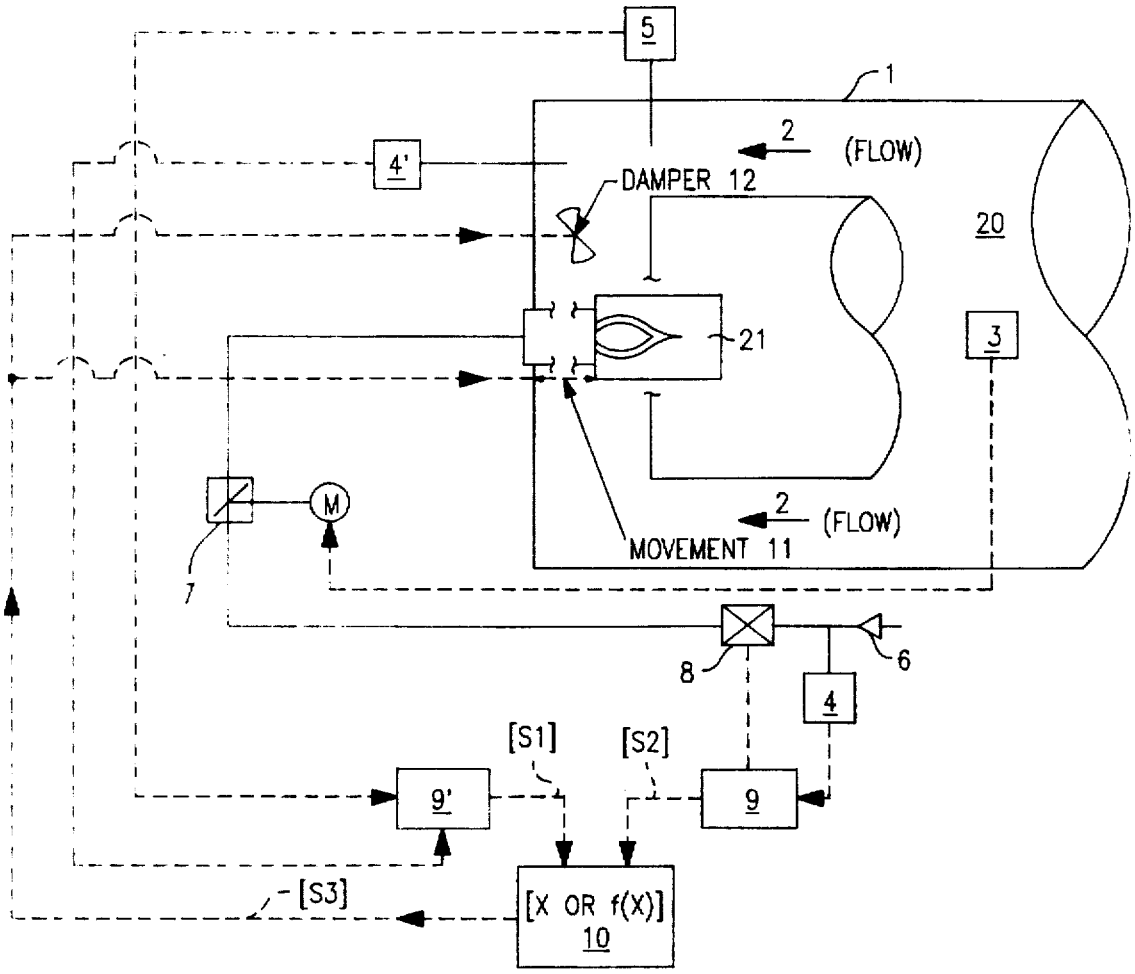
FIG. 1 is a schematic view of the control system in accordance with the present invention.

Turning now to FIG. 1, there is shown generally at 1 a closed operational system including a oxidation chamber 20 and a secondary air burner 21. A temperature sensor (not shown) such as a thermocouple senses the temperature in the oxidation chamber 20, and sends a signal regarding the same to a controller 3 which compares that temperature with a pre-determined set-point temperature for the thermal oxidizer. From this procedure, the amount of supplemental fuel that needs to be burnt in the secondary air burner 21 is determined. Thus, in the event that the chamber 20 temperature is lower than the set-point temperature, additional heat is required and the fuel valve 7 responsive to the controller 3 is modulated open to send fuel to the burner via burner fuel supply 6. In the event the chamber 20 temperature is higher than the set-point temperature, less heat is required and the fuel valve 7 is modulated closed to decrease or cease the flow of fuel to the burner from the burner fuel supply 6.

In order to maintain a desired constant or substantially constant stoichiometry in the burner, a burner fuel flow metering device 8 and a process gas flow metering device 5 are used. The burner fuel flow metering device 8 is based in this case on pressure differential, but is not to be limited thereto, as those skilled in the art will appreciate that any flow metering technology may be used without departing from the spirit and scope of the invention. Suitable examples include anemometers (e.g., vane anemometers, hot-wire anemometers, hot-film anemometers, heated-thermocouple anemometers, thermistor anemometers and laser-Doplar anemometers), current meters, venturimeters, flow nozzles, orifice meters, rotameters, etc. The fuel flow device 8 monitors the flow of fuel fed to the burner and transmits a signal to a measuring transducer 9 based upon that flow. Similarly, the process gas flow metering device 5 monitors the flow of process gas 2 and sends a signal to a measuring transducer 9' based upon that flow. (Examples thereof for flow measurements are the same as for the fuel flow measuring device.) The transducers 9 and 9' transform the signals into signals S1 and S2, respectively, which are sent to an evaluator 10 where they are compared with a set-point or set-point function (x or f(x)). The evaluator 10 generates a third signal S3 that is a result of this comparison, which signal S3 causes a flow resistance of the process gas. This resistance results in a diversion of a portion of the process gas 2 for the combustion of the supplementary fuel. Such a flow resistance can be achieved by means of one or more dampers 12 associated with the burner 21, which opens or closes according to signal S3, thereby modulating the amount of process gas entering the burner 21, or can be achieved by movement of the burner 21 or parts of the burner as shown by arrow 11.

Figure 3:
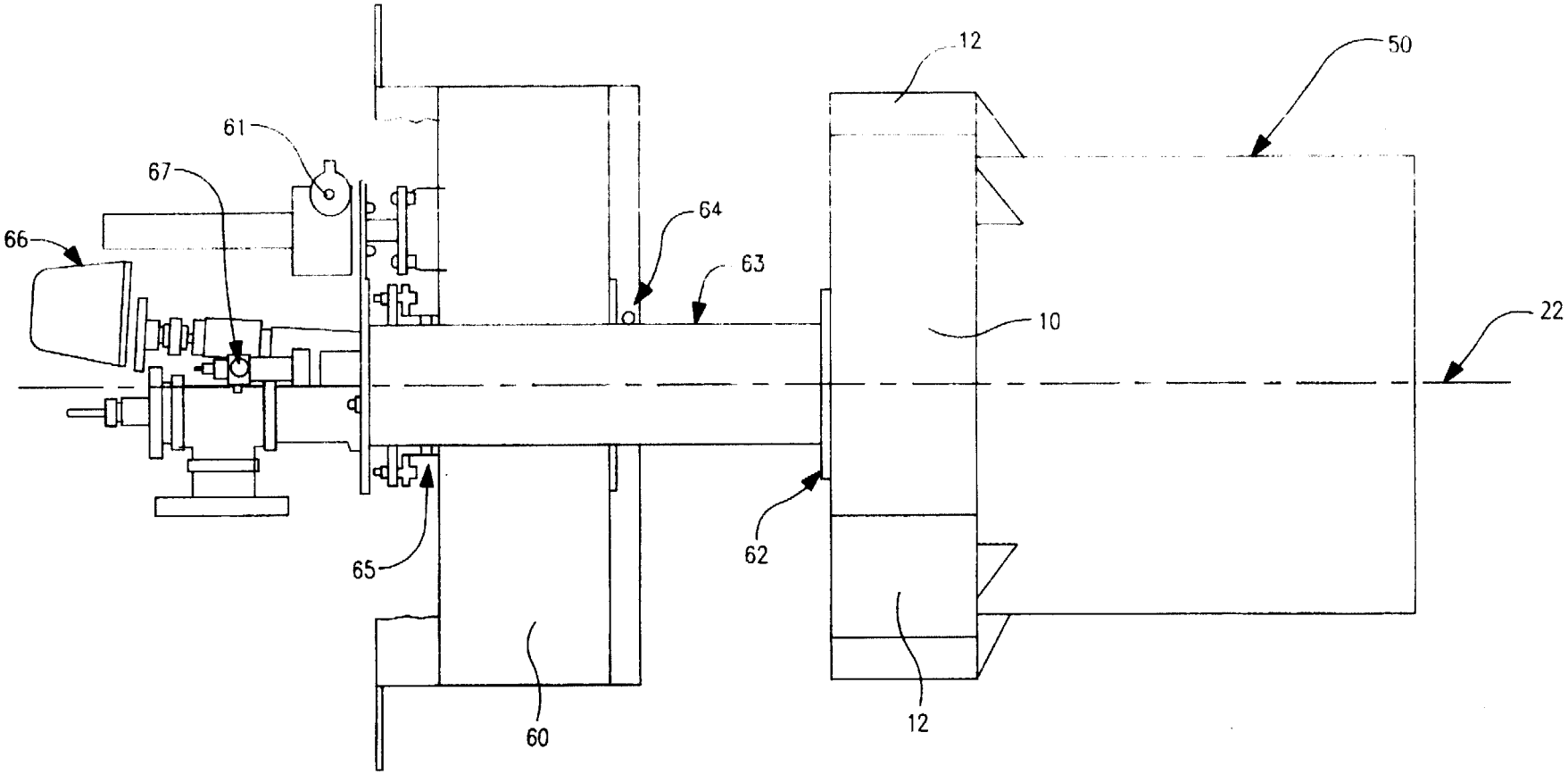
FIG. 3 is a schematic view of a burner assembly in accordance with one embodiment of the present invention.

With respect to this latter embodiment, for example, when the burner, which is mounted inside the oxidizer in front of a flame tube having a conical inlet, is moved toward the flame tube inlet, its open area decreases, and the pressure for the passing flow therefore increases. Thus, more flow streams inside the burner. (A pressure equilibrium exists between the burner's by-passing flow and the flow streaming inside the burner. This equilibrium adjusts accordingly to the pressure in the room before the flame tube inlet.) The movement of the burner is preferably accomplished via linear motion, with FIG. 3 showing a preferred assembly. The burner combustion chamber 50 and swirl mixing chamber 10 are attached to lance assembly 63 by a mounting flange 62. This assembly passes through the center of the insulated mounting housing 60 on the longitudinal axis 22 of the burner. Hot side bearing assembly 64 and cold side bearing assembly 65 support the moving sections (i.e., the lance 63, the mixing chamber 10 and the combustion chamber 50) of the burner. In and out linear motion of the burner relative to the housing 60 is controlled by the positioning linear actuator 61 coupled to lance 63. (A UV flame detector 66 and spark ignitor 67 are also shown.) Linear movement of the burner changes the dimensions of the gap formed between the flue gas outlet of the burner and the chamber in which the burner combustion chamber is housed, such as a flame tube, so as to change the pressure drop of the process gas flowing past the burner flue gas outlet.

Either or both of the burner fuel flow metering device 8 and/or the process gas flow metering device 5 can be modified by being in communication with a temperature instrument 4 or 4' for taking into account any temperature influence on the density of the flow mediums of the fuel or process gas. In this embodiment, the signal generated by temperature instrument 4 and/or 4' also is sent to evaluator 10.

Figure 2:
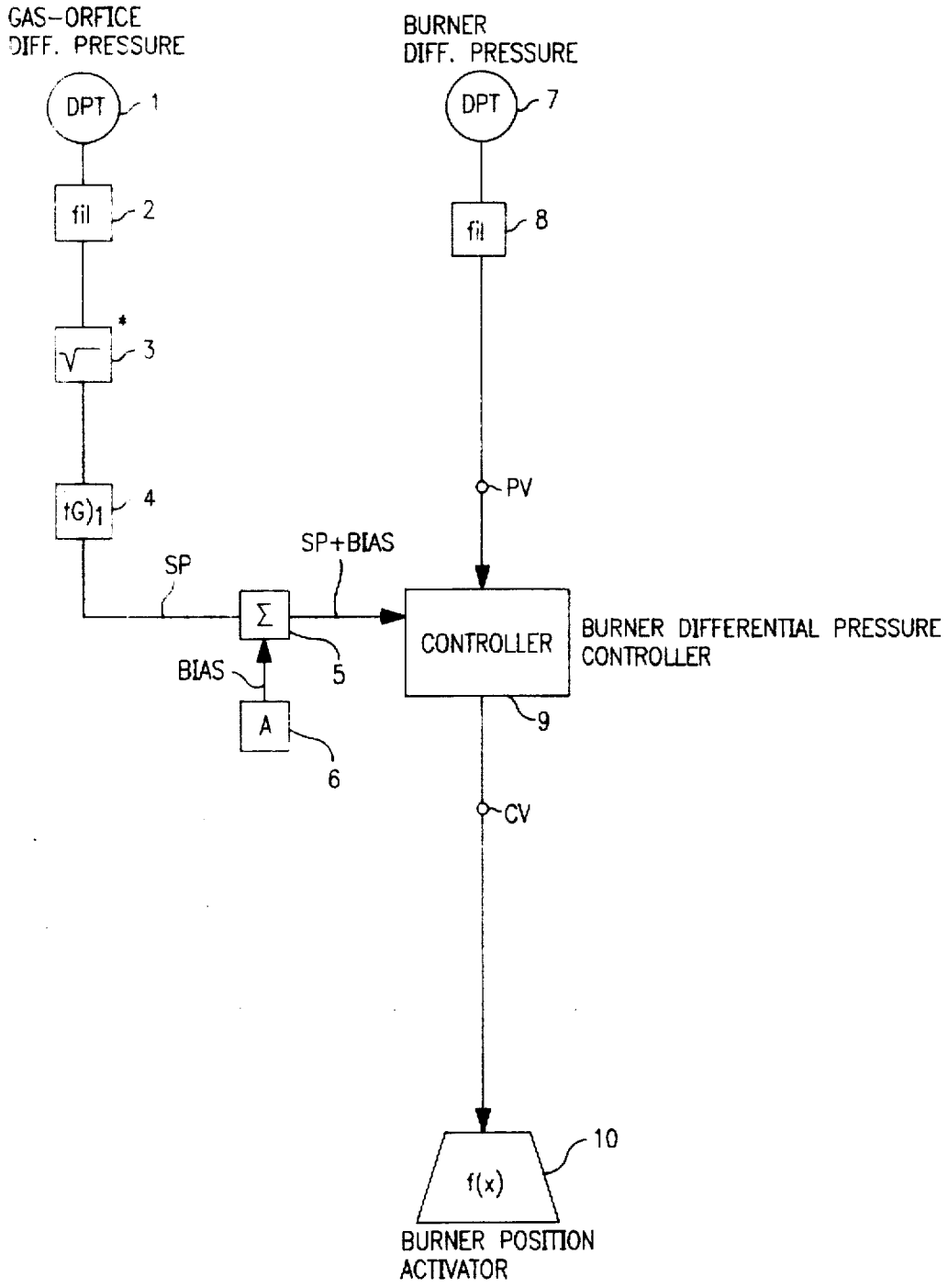
FIG. 2 is a block diagram of a control system useful in the present invention.

A control system useful in the present invention can be described with reference to FIG. 2. Function block (FB) 1 is the primary burner fuel flow metering device (corresponding to element 8 in FIG. 1). This device is comprised of a signal producing element and a transmitter used to covert the physical flow measurement into an instrument signal. FB 2 is a digital or analog signal filter network used to minimize process noise on the process control signal. FB 3 is a square rooting extracting function that can be applied to the process variable signal, but may not be necessary, depending upon the nature of $f(x)_1$ (function block 4). FB 4 is the equation that calculates the baseline burner differential set-point based on the primary fuel flow rate. FB 5 is used to sum a negative or positive bias to the baseline burner differential set-point to compensate for variations that are encountered due to each individual system's characteristics. The positive or negative bias is set by FB 6, which is set in the field based on field conditions. FB 7 is the burner differential pressure measuring primary element and associated transmitter. FB 8 is a digital or analog signal filter network used to minimize process noise on the process control signal. FB 9 is the burner differential pressure controller. FB 10 is the burner differential pressure final control actuation device.

In operation, primary fuel flow to the burner is controlled from a temperature controller and its measured signal is used to develop a baseline burner differential pressure controller set-point. The baseline differential pressure set-point is biased vertically to shift the baseline set-point to custom fit the curve to the application. Burner differential pressure is then controlled based on the primary burner fuel flow. As process combustibles increase, the resultant increase in oxidation raises the controlled temperature and decreases the primary fuel flow, thereby decreasing the burner differential pressure set-point. This restricts the influx of process combustibles and reestablishes the temperature to its set-point temperature and desired stoichiometric fuel/oxygen ratio. Similarly, as process combustible decrease, the resultant decrease in oxidation lowers the controlled temperature and increases the burner differential pressure set-point. This increases the influx of process combustibles and reestablishes the temperature to its set-point temperature and desired stoichiometric fuel/oxygen ratio.

What is claimed is:

1. Control system for maintaining a substantially constant stoichiometry of burner fuel and process gas in a secondary air burner of a closed operational system having an oxidation chamber, said system comprising:

temperature sensing means in said oxidation chamber for sensing the temperature therein;

means for modulating the flow of fuel to said burner in response to said sensed temperature;

burner fuel flow measuring means for measuring the flow of fuel to said burner and generating a first signal in response thereto;

process gas flow measuring means for measuring the flow of process gas to said burner and generating a second signal in response thereto;

evaluator means for comparing said first signal and said second signal and for generating a third signal based upon said comparison; and means responsive to said third signal for regulating the amount of said process gas that is combusted by said burner.

2. The control system of claim 1, wherein said burner fuel flow measuring means is responsive to said temperature of said fuel.

3. The control system of claim 1, wherein said process gas flow measuring means is responsive to said temperature of said process gas.

4. The control system of claim 2, wherein said process gas flow measuring means is responsive to said temperature of said process gas.

5. The control system of claim 1, wherein said means for regulating the amount of said process gas that is combusted by said burner comprises a damper.

6. The control system of claim 1, wherein said means for regulating the amount of said process gas that is combusted by said burner comprises means for moving said burner relative to said oxidation chamber.

7. Process for maintaining a substantially constant stoichiometry of burner fuel and raw process gas in a secondary air burner for a closed operational system having an oxidation chamber, said process comprising:

sensing the temperature in said oxidation chamber;

modulating the amount of fuel fed to said burner in response to said sensed temperature;

measuring the flow of fuel to said burner and generating a first signal in response thereto;

measuring the flow of process gas flowing to said burner and generating a second signal in response thereto;

comparing said first signal and said second signal and generating a third signal based upon said comparison; and regulating the amount of said process gas that is combusted by said burner in response to said third signal.

8. The process of claim 7, wherein the amount of said process gas that is combusted by said burner is regulated by damper means.

9. The process of claim 7, wherein the amount of said process gas that is combusted by said burner is regulated by moving said burner with respect to said oxidation chamber.

10. The process of claim 7, further comprising measuring the temperature of said fuel and modifying said first signal in response thereto.

11. The process of claim 7, further comprising measuring the temperature of said process gas and modifying said second signal in response thereto.

12. The process of claim 10, further comprising measuring the temperature of said process gas and modifying said second signal in response thereto.

* * * * *